US005769444A

United States Patent [19]

Mason

[11] Patent Number: 5,769,444

[45] Date of Patent: Jun. 23, 1998

[54] SNOWSHOE BINDING

[76] Inventor: James Frederick Mason, P.O. Box 253, Paradise, Mich. 49768

[21] Appl. No.: 688,356

[22] Filed: Jul. 30, 1996

Related U.S. Application Data

[63] Continuation-in-part of Ser. No. 417,199, Apr. 5, 1995, abandoned.

[51] Int. Cl.[6] ..... A63C 13/00

[52] U.S. Cl. ..... 280/600; 280/619; 36/122; 36/125

[58] Field of Search ..... 280/600, 611, 280/619, 622, 11.12, 11.14, 11.3, 116, 122, 123, 124, 125

[56] References Cited

U.S. PATENT DOCUMENTS

| | | | |
|---|---|---|---|
| 2,158,599 | 5/1939 | Weber | 280/614 |
| 2,172,669 | 9/1939 | Taft | 280/614 |
| 2,246,153 | 7/1941 | Wallace | 280/614 |
| 2,385,944 | 10/1945 | Ruecker | 366/125 |
| 2,412,474 | 12/1946 | Scott-Paine et al. | 280/600 |
| 2,445,610 | 7/1948 | Drake | 280/611 |
| 2,462,281 | 2/1949 | Piane | 280/619 |
| 2,686,059 | 8/1954 | Whitaler | 280/614 |
| 2,738,596 | 3/1956 | Walsh | 36/124 |
| 2,821,031 | 1/1958 | Howe | 36/125 |
| 2,987,834 | 6/1961 | Howe | 36/125 |
| 3,885,327 | 5/1975 | Maki | 36/125 |
| 4,116,462 | 9/1978 | Buel | 280/614 |
| 4,327,504 | 5/1982 | Welsch | 36/122 |
| 4,604,817 | 8/1986 | Ramboz | 36/116 |
| 5,014,450 | 5/1991 | McGrath | 280/11.3 |
| 5,259,128 | 11/1993 | Howell | 36/122 |
| 5,440,827 | 8/1995 | Klebhan et al. | 36/122 |
| 5,531,035 | 7/1996 | Forest . | |

FOREIGN PATENT DOCUMENTS

| | | | |
|---|---|---|---|
| 214195 | 4/1941 | France | 280/619 |
| 331797 | 11/1935 | Italy | 280/619 |
| 29879 | 2/1919 | Norway | 280/619 |
| 486189 | 5/1938 | United Kingdom | 280/611 |

*Primary Examiner*—Robert J. Oberleitner
*Assistant Examiner*—Min Yu
*Attorney, Agent, or Firm*—Weiner, Carrier, Burt & Esser, P.C.; Irving M. Weiner

[57] ABSTRACT

A binding system for attaching a boot to a snowshoe wherein a greater percentage of the energy from the movements of the boot is transmitted to the snowshoe binding and the snowshoe which then assists in the more efficient movement of the snowshoe. The binding system also provides increased control of the snowshoe. The binding system comprises resilient elastic flexible material attached to the perimeter of the boot and straps looped through the front of the toe area of the boot to points in the front perimeter of the snowshoe and also a resilient elastic strap around the instep of the boot attached to the rear section of the snowshoe.

7 Claims, 2 Drawing Sheets

SNOWSHOE BINDING

This is a CIP of application Ser. No. 08/417,119, filed Apr. 5, 1995, now abandoned.

BACKGROUND OF INVENTION

The snowshoe is a device that spreads the weight of its user over a greater area than its user's boot or shoe reducing the depth in which the user sinks the said snow and thereby allows its user to travel more easily over snow. Along with the wheel, the snowshoe is one of the oldest forms of transportation known to man. While anthropologists can only find evidence of the snowshoe dating back approximately 2,000 years, it has been suggested that they may be as old as 20,000 years.

In the entire history of its use, the snowshoe has seen only a few refinements to its original design. Displacement of body weight is one of the main goals of all snowshoes. Traction by means of a toe hole and webbing was devised to better carry and pull burdens, crampons have been employed to better negotiate ice and snow crust conditions and also to supplement the traction lost when replacing rawhide mesh with a solid neoprene. Straight tracking was needed in the more open areas, so elongated tails were devised; in the more closed wooded locations, the same tails were eliminated to facilitate travel around trees.

The binding attaches the snowshoe to the user's boot or shoe. The energy from the user's movements is transmitted by the binding from the user's boot or shoe to the snowshoe. While Maki in U.S. Pat. No. 3,885,327 teaches the use of resilient flexible material, Maki does not teach that the binding returns energy to its user and also does not show the resilient material being independent of the anchors contained in the bindings. The present invention utilizes the energy that is lost with present bindings by taking the energy from the downward motion of the toe of the boot and holding said energy in the front section and the rear section of the snowshoe until just before the user proceeds to the next step. The present invention is extremely efficient in all conditions and terrains and the user's speed is thereby increased with the present invention. Conserved or stored energy from the present invention induces a positive-thrust in the next step and creates a spring-like movement. The incorporation of the spring-like resilient properties of modern materials into the binding results in an efficient product. Furthermore, the present invention is self-correcting of any slippage forward or to the side. The present invention creates continuous degrees of tension by pulling at the toe area of the boot utilizing the weight of the user to eliminate any slippage each motion. The material that surrounds the boot with the ends of said strap extending beyond the rear of the boot is continuously pulled forwarded and corrected. The present invention also provides improved control of the snowshoe. Lateral turning and heel-toe lift are greatly improved by means of said continuous tension. The stepping motion reduces negative torque and tail drag. In addition, backing up is easier and more natural with the present invention, which is often required by rescuers and other outdoor workers. In one form of the present invention, said ends of the strap bounce on the snowshoe from the energy of each step thereby causing snow to fall off the snowshoes. Said ends of the strap ease the removal of the boot from the snowshoe especially when the snowshoe is in the water. Instead of unbuckling the binding under water, the user may just reach down and pull the flexible resilient material and release the boot. The present invention is much more user friendly that the prior art in that it requires less bending of the back and legs in the removal of said snowshoe. The present invention allows handicapped persons to attach the binding with one hand, aided by any hook-type device when said person cannot bend. Said ends of the strap allow for the removal of the snowshoe solely by the uses applying downward pressure from the user's first snowshoe or boot to said second strap and pulling the second boot from the second snowshoe. For example, the user could step on the end of the strap of the snowshoe on the right foot with the snowshoe on the left foot and lift the boot out of the binding of the snowshoe on the right foot while standing or sitting and use the boot to step on the strap on the snowshoe on the left foot and lift the boot on the left foot out of the binding.

In another form of the present invention, there is strap of resilient flexible material placed around the upper instep of the user's foot or ankle which is attached to the rear of the snowshoe. Said strap may be attached at an elevation near the surface of the snowshoe or may be attached at an elevation equal to the height of the upper instep or ankle of the user's foot through the use of a bracket-type device. The tension of said strap may be adjusted depending on the user's desires. Furthermore, in another form of the invention, the end of said resilient elastic-type flexible material attached to the perimeter of the user's boot is attached to the rear of the snowshoe at an elevation near the surface of the snowshoe or may be attached at an elevation equal to the height of the upper instep or ankle of the user's foot through the use of said bracket-type device. The tension of said strap may also be adjusted depending on the user's desires.

Moreover, the binding is easily adapted to all wood rawhide type snowshoes and certain aluminum/neophren models.

SUMMARY OF THE INVENTION

The invention is a snowshoe binding system that utilizes a one-piece-elastic-type circumference loop of a flexible resilient material having a tail portion that is sized in length to accommodate the size of user's foot. Said one-piece-elastic-type circumference loop of a flexible resilient material can be easily adjusted through the use of a fastener located to the rear of the boot. Said tail portion with the aid of a ball-like end allows handicapped individuals or individuals having difficulty bending to grip down to the heel of their boot to attach the binding merely by placing their foot into said loop, stretching forward slightly and pushing their boot forward into said loop and then gripping said tail portion and pulling said loop up around the heel of user's boot. Any hook-type device can be attached to the tail portion of said loop so that the user is not required to bend down to said tail portion. Removal of the snowshoes is accomplished by crossing and stepping down the inside of the top snowshoe over said tail section of the opposite snowshoe while raising the boot's heel and pulling backward on the foot. The bottom snowshoe is then removed and the process is then repeated except that the other boot without the snowshoe on it is utilized to remove the remaining snowshoe. At no time are the user's hands required to remove the snowshoes making the present invention the simplest and -safest design should the user have the misfortune to fall through ice.

The present invention includes connecting devices that permit said resilient elastic-type material attached to the user's boot to move independently of said connecting devices which are attached to the front outside edges of said snowshoe. Said connecting devices tend to center the foot on the snowshoe causing the snowshoe to track straight ahead, eliminating the need for the tail of the snowshoe. The present invention also includes a resilient elastic-type strap around the instep of the boot and is attached at an elevation equal to the said person's instep at each side of the back outer perimeter of the snowshoe which is capable of further stretching when the heel of said boot is lifted up from the snowshoe. Said connecting devices and said strap help eliminate tail drag and also allow the user to go backwards in said snowshoes without the use of ski poles. Furthermore, if the user so desires, the present invention is operational without said strap around the instep of the boot and can be easily unattached.

DESCRIPTION OF THE PREFERRED EMBODIMENTS

Figure 1:
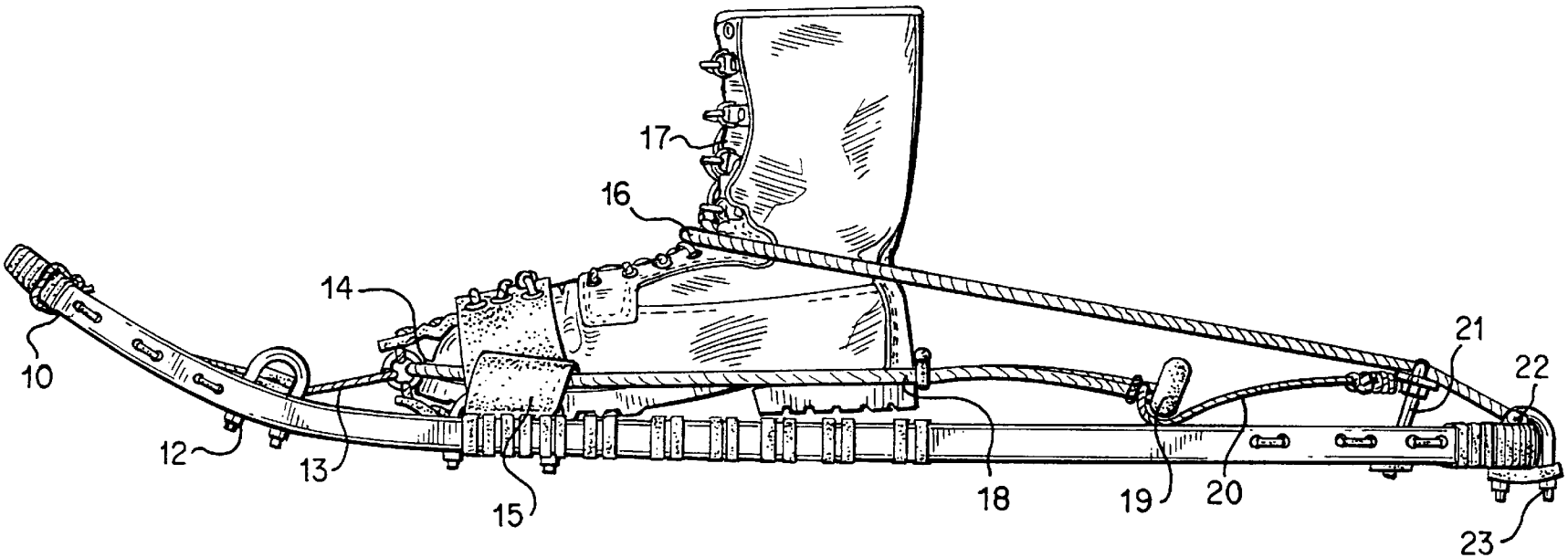
FIG. 1 is a side elevation of the snowshoe binding constructed in accordance with the invention.
Figure 2:
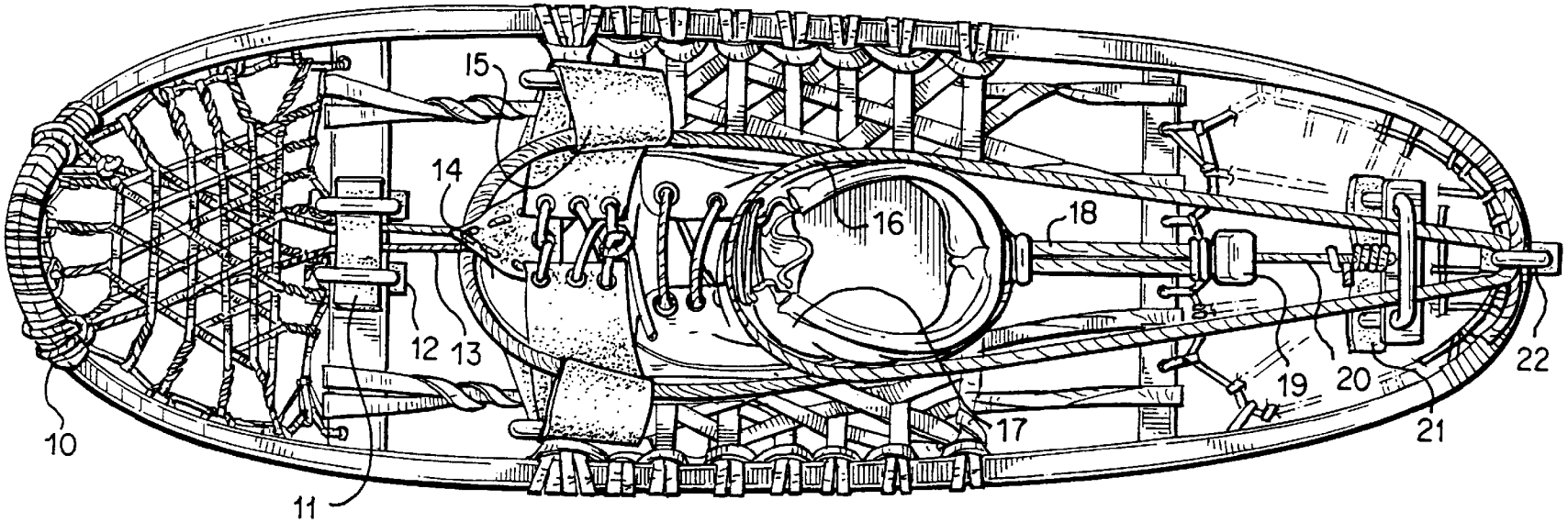
FIG. 2 is a top view of a snowshoe binding of FIG. 1.

A preferred form of the present invention includes the resilient elastic-type flexible material 18 attached to the perimeter of the boot 18 and straps looped through the toe area of said boot to points 10 in the front perimeter of said snowshoe and also a resilient elastic-type strap 16 around the instep 17 of said boot attached to the rear section 22 of said snowshoe 22 as shown in FIG. 1. The primary focus of the present invention is that the downward force from the user is stored within the binding and the snowshoe and then released as the user proceeds to his next movement. This aspect of the invention will cause the user to experience a spring-like sensation as the user moves through the snow.

The resilient elastic-type material 18 that fits around the boot can be sized and adjusted according to the user's preferences simply by changing the dimension of said resilient elastic-type material. The loops 15 that anchor said resilient elastic-type material 18 can also be adjusted depending upon the amount of support or tightness that the user desires around said resilient elastic-type material 18. The tightening of said loops 15 will generate more lateral support and control. The toe portion 14 of said resilient elastic-type material 18 is connected to the front of the snowshoe with another resilient elastic-type material 13 that can be woven between the lacing of the snowshoe that rests upon the front crossbar of the snowshoe and can be placed between two pieces of rubber 11. This aspect of the invention improves control of the snowshoe and also causes the snowshoe to flex and release with each step. The weight of the user is also more evenly distributed over the snowshoe. The force of the boot movement will cause said additional resilient elastic-type 13 to slide between said two pieces of rubber 11 or other material thereby transmitting energy to and from the front portion of the snowshoe.

The strap 16 that is placed around the instep 17 of the boot 17 is attached to the rear of the snowshoe. The tension of this strap 16 can be adjusted as desired by the user. Said adjustments will affect the amount of tail drag and control the user has over the rear portion of the snowshoe. The present invention also includes a device 21 in the rear of the snowshoe to raise the elevation of said strap 16 up to the elevation of the instep of the user's boot while transmitting force to the rear of the snowshoe. In addition, said resilient elastic-type material 18 around the boot can be extended 19 and 20 beyond the heel of the boot or connected to the rear of the snowshoe.

The present invention also can reduce the apparent weight of the snowshoe during use by reducing the amount of snow that sticks to the snowshoe. When said resilient elastic-type material 18 around the boot is extended beyond the heel and not connected to the rear of the snowshoe, there is a bouncing of said extension 19 of said resilient elastic-type material 18 on the snowshoe which can result in snow being knocked off the snowshoe with the movements of the user. Moreover, the movement of the toe area 14 below the boot causes snow to fall off the underside of the snowshoe in the area of the toe of the boot thereby making any cleats more effective.

The present invention is easily repairable as a result of the type of materials utilized. For example, the resilient elastic-type material 18 around the boot can easily be changed while outside in the elements. In fact, any material that is flexible with the ability to stretch or give can be substituted in the present invention. The resilient elastic-type strap 16 around the instep 17 of the boot can be changed while outside in the elements or deleted until repair is made. The deletion of said resilient elastic-type strap 16 around the instep 17 of the boot will cause an loss of efficiency in the use of said snowshoe and a loss of mobility in the reverse direction; however, the present invention is operational without said strap.

Another aspect of the present invention is that the cleats 12 and 23 are an integral part of the snowshoe binding. Instead of being an attachment to the snowshoe, these cleats 12 and 23 are part of the snowshoe binding thereby reducing losses of forces and improving control and traction.

When the present invention is operating as shown in FIG. 1, the user's efficiency is increased as a result of the spring-like motion produced from the storage of energy in the flexing of the snowshoe and the stretching of the binding as the user's boot moves through each step. The present invention includes front and rear connections 10, 11, 21 and 22 to the snowshoe which transmit force directly to the outer perimeter of the snowshoe thereby reducing the loss of force and/or momentum generated by the user's boot. Said front and rear connections also provide improved control of the snowshoe by giving the feel that the snowshoe is an integral part of the user's boot while distributing the user's weight more evenly over the entire area of the snowshoe. In addition, the user is able to move in the reverse direction with greater ease.

I claim:

1. A snowshoe binding, comprising:

a first resilient elastic material adapted to strap onto a perimeter of a person's boot;

anchors adapted to anchor said first resilient elastic material to a snowshoe;

a connecting device connected to the first resilient elastic material at the front of the first resilient elastic material, and is adapted to connect said first resilient elastic material to a front portion of said snowshoe;

a second resilient elastic material connects to said first resilient elastic material by said connecting device;

said first resilient elastic material being free to move indepenently of said anchors where said first resilient elastic material is capable of stretching onto aid perimeter of said boot forming a position of original stretch, and further capable of forming a position of further stretch during use together with said connecting device that permits said first resilient elastic material to move independently of said connecting device; and said second resilient elastic material extends forwardly of a toe area of said boot and is adaptable to being attached to said front portion of said snowshoe which is capable of further stretching from a position of original stretch to a position of further stretch when a heel of said boot is lifted up from said snowshoe and which is capable of returning to said position of original stretch when said heel of said boot is placed contact with said snowshoe, whereby the combination of said stretching of said first resilient elastic material onto said perimeter of said boot together with the stretching of said second resilient elastic material, and the resulting resistance force from said binding caused by he stretching which is thereby capable of assisting said person by causing a spring return motion as a result of said resilient elastic materials stretching back from their position of further stretch to their position of original stretch during use.

2. A binding as claimed by claim 1, wherein:

said first resilient elastic material contains an elongated portion at said heel of said boot of sufficient size with a ball-shaped end to be capable of gripping by hand enabling said per on to stretch said binding up over said heel or remove said binding by pulling said elongated portion down from said heel.

3. A binding as claimed by claim 1, wherein:

said first resilient elastic material contains an elongated portion at said heel of said boot of sufficient size capable of gripping by hand enabling said person to stretch said binding up over said heel or remove said binding by pulling aid elongated portion down from said heel.

4. A binding as claimed by claim 1, wherein:

said first resilient elastic material is attached to a flexible material that is adaptable to attach to each side of front outer perimeter of said snowshoe which is capable of providing greater control of said snowshoe.

5. A binding as claimed by claim 1, wherein:

a third resilient elastic material is strapped around an instep of said person's boot and is adaptable to attach at any elevation up to the elevation of said person's instep at a rear outer perimeter of the snowshoe which is capable of further stretching when said heel of said boot is lifted up from the snowshoe which is also capable of returning to the prior stretched position when said heel of said boot is placed in contact with said snowshoe thereby capable of assisting said person by causing a spring return motion as a result of said stretching during its use which also provides greater control of the snowshoe.

6. A binding as claimed by claim 1, wherein:

said first resilient elastic material that is capable of stretching onto said perimeter of the person's boot is capable of being adjusted to fit the particular size of the person's boot at said heel of the boot through a clamp device.

7. A binding as claimed by claim 1, wherein:

said second resilient elastic material which is adaptable to being attached to front perimeter edges of the snowshoe is also adaptable to being attached to the snowshoe in the area between the toe of the boot and the front perimeter edges of the snowshoe.

* * * * *